United States Patent [19]

Lincourt

[11] Patent Number: 4,540,147

[45] Date of Patent: Sep. 10, 1985

[54] JACK STAND ATTACHMENT

[76] Inventor: William R. Lincourt, 54 E. Bowery St., Newport, R.I. 02840

[21] Appl. No.: 535,280

[22] Filed: Sep. 23, 1983

[51] Int. Cl.[3] ..... E04G 25/00

[52] U.S. Cl. ..... 248/352; 248/351; 254/133 R

[58] Field of Search ..... 248/351, 352; 254/DIG. 4, 133 R, 134

[56] References Cited

U.S. PATENT DOCUMENTS

| | | | |
|---|---|---|---|
| 2,493,295 | 1/1950 | Kron | 248/352 |
| 2,514,095 | 7/1950 | Schreiber | 248/352 |
| 3,891,177 | 6/1975 | Jerrel | 248/352 |
| 4,042,202 | 8/1977 | Molinari | 248/352 |
| 4,141,526 | 2/1979 | John | 248/352 |
| 4,328,903 | 5/1982 | Baars | 248/359 R |

FOREIGN PATENT DOCUMENTS

| | | | |
|---|---|---|---|
| 0528493 | 10/1940 | United Kingdom | 248/351 |
| 0601328 | 5/1948 | United Kingdom | 248/352 |

*Primary Examiner*—William H. Schultz
*Assistant Examiner*—Ramon O. Ramirez
*Attorney, Agent, or Firm*—Barlow & Barlow, Ltd.

[57] ABSTRACT

A jack stand attachment for use with a conventional support stand is disclosed, the attachment having a socket means that is slidably received on the load rest of the support stand. On the upper surface of the socket means, there is found a V-shaped rest and link means are pivoted to the attachment which have apertures therein near the terminus thereof that will accept a wheel lug bolt.

1 Claim, 6 Drawing Figures

JACK STAND ATTACHMENT

BACKGROUND OF THE INVENTION

This invention relates generally to an improvement in an attachment for a jack stand, and particularly to an attachment which will provide a support for a wheel of a vehicle that is constructed either with or without a stub shaft.

In the automotive repair industry, it has been common to remove the tires and wheels of a vehicle for working on part of the body. Stands that are available in the industry comprise linkage members which can engage the studs that are on the brake drum and take the form as seen for example in the Kron U.S. Pat. No. 2,493,295. Other forms of similar stands are seen in the Jerrel U.S. Pat. No. 3,891,177. When a vehicle is provided with a stub shaft, the shaft may be engaged by a stand such as is seen in the Schreiber patent, U.S. Pat. No. 2,514,095. When a vehicle is thus supported, it makes it more convenient for frame straightening apparatus to be passed under the chassis of the vehicle and exert the necessary pulls to straighten the body. Since jack stands are readily available in an automotive shop, it would not require the inventory of several types of support means for foreign or domestic automobiles; and would therefore provide a single attachment for a conventional piece of apparatus.

SUMMARY OF THE INVENTION

The present invention contemplates a jack stand attachment for use with a conventional jack stand, which includes a multilegged base having a vertically reciprocating shaft in the base, which shaft is provided with a plurality of ratchet teeth and a dog for engaging the ratchet teeth to maintain the shaft in a fixed position of elevation. The jack stand attachment includes a socket means that is sized and shaped for being slidably received on the load rest at the end of the shaft and includes a V-shaped rest that lies on the upper surface of the socket means, which socket is preferably made rectangular with a pair of side and a pair of end walls, together with a top wall. On the top wall is a V-shaped rest, while pivotally mounted to one of the side walls are a pair of links which have apertures near the terminus thereof, the apertures being arranged to be pivoted into position to engage the lugs on the brake drum of a vehicle.

It is the principal object of the present invention to provide an attachment for a jack stand which will eliminate having separate pieces around the shop for specific purposes, and to improve upon the utility of jack stands, thereby increasing the flexibility thereof. A further object of the present invention is to provide a versatile attachment for a conventional jack stand which is economical to construct and simple to use.

Other objects and advantages of the present invention will be evident from the following detailed description when read in conjunction with the accompanying drawings.

DETAILED DESCRIPTION OF THE PREFERRED EMBODIMENT

Figure 1:
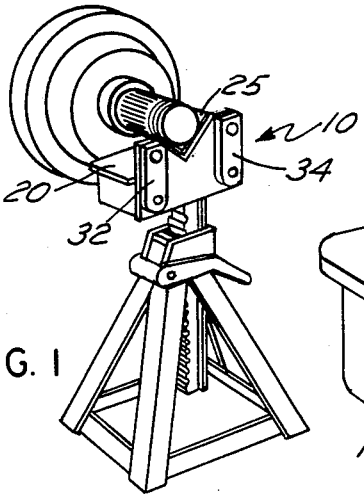
FIG. 1 is a perspective view of the jack stand adapter of the invention supporting a stub shaft that extends from a brake drum of an unconventional vehicle without lugs.
Figure 2:
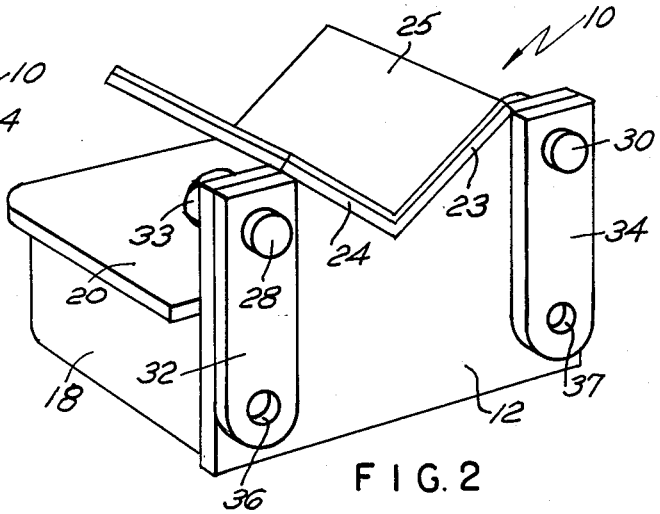
FIG. 2 is an enlarged perspective view of the adapter of this invention.
Figure 3:
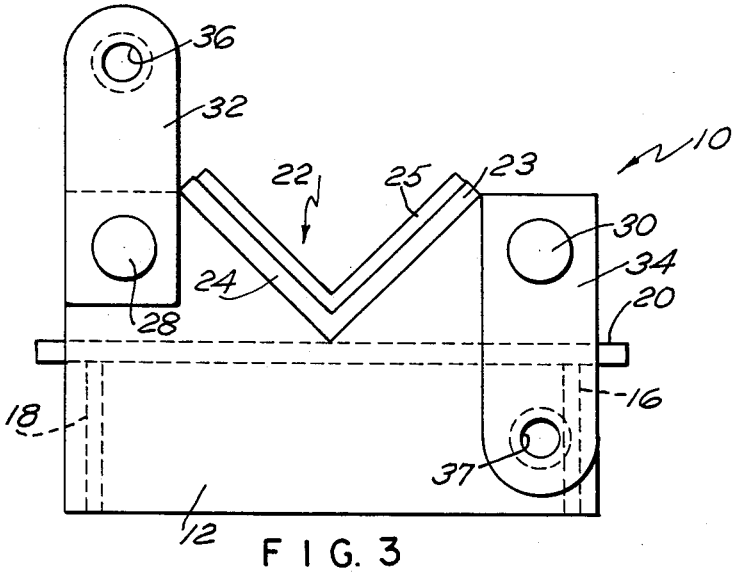
FIG. 3 is a front view thereof.
Figure 4:
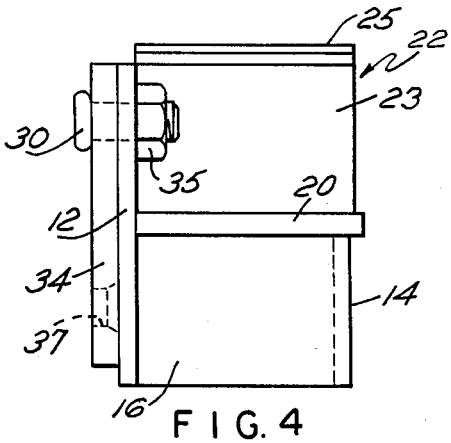
FIG. 4 is a side view thereof.
Figure 5:
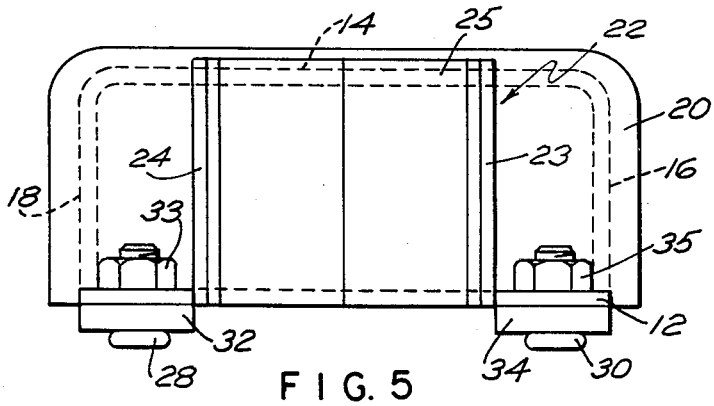
FIG. 5 is a top view thereof.

The jack stand attachment of the present invention is generally designated 10 and comprises a socket which has a front wall 12 an opposite side wall 14 and a pair of end walls 16 and 18. Joining these parts is a top wall 20. Resting on the top wall 20 is a V-shaped rest 22 which is supported by an extension of the side wall 12, which side wall is provided with a V-shaped cut-out onto which the two plates 23, 24 of the V-shaped rest 22 will fit. Preferably the plates are welded to the front wall plate for support and orientation, and also the juncture of the two plates is welded to the top wall 20. The V-shaped rest may also be provided with an antiscuffing material 25, which may be cemented in place and may consist of any suitable tough material such as belting material.

The front wall plate 12 is provided with a pair of spaced apertures through which pivot bolts 28 and 30 may extend. The pivot bolts mount links 32, 34 that are provided with apertures 36, 37 near the terminus thereof; and ideally the pivot bolts 28 and 30 are provided with spline shaft portions which may be driven in to the links 32, 34; and in this fashion they may be tightened into position merely by holding the link and tightening up the nuts, such as the nuts 33, 35 that are provided for each of the bolts.

The jack stand adapter is preferably constructed of steel and the various elements thereof may be suitably secured to one another by means of welding. Inasmuch as front wall plate 12 has considerable load to place thereof in shear, it is suggested that it be made from $\frac{3}{8}''$ cold rolled plate, while the remainder of the adapter may be constructed of $\frac{1}{4}''$ plate. The links should be made from 7/16" steel.

Figure 6:
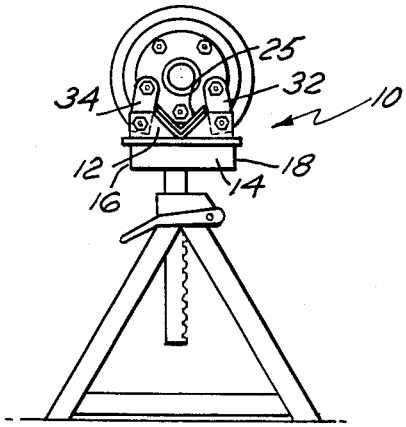
FIG. 6 is an elevation view of the jack stand and adapter supporting a brake drum.

The jack stand adapter provides the user with flexibility when used in conjunction with a conventional jack stand. The obvious first application of the attachment arises when the operator desires to engage a stub shaft of a wheel such as is found on some British built automobiles. In that case, the situation as shown in FIG. 1 of the drawings attains. The second application arises when the operator desires to engage the brake drum of a conventional automotive vehicle having lug bolts as seen in FIG. 6, in which case the links 32, 34 may be pivoted up into position as seen in FIG. 6 and the wheel lug bolts may be passed through the apertures in the end of the links. This arrangement also permits the use of the adapter on a brake drum having tapped holes to receives bolts, in which case the bolts pass through the apertures in the end of the links. With two jack stands in use, one on either end of an axle, the entire end of an automotive vehicle is relatively free of obstruction, save for the jack stands, which permit the operator of a body shop to move his frame straightener apparatus underneath the vehicle with little or no obstruction.

I claim:

1. A jack stand attachment for use with a conventional support stand of the type which includes a multilegged base having a shaft reciprocal in the base and a load rest having a substantially flat upper surface at the end of the shaft comprising, socket means sized for being received on top of the load rest, and having a front wall, an opposite side wall, a pair of end walls and a top wall;

a V-shaped rest lying on the upper surface of the top wall, said rest defining an elongated saddle, said front wall extending above the top wall and supporting the V-shaped rest, a pair of link means pivoted to the front wall with apertures in the terminus thereof to accept a wheel lug bolt.

* * * * *